United States Patent [19]

Barna

[11] 4,364,124

[45] Dec. 21, 1982

[54] TROUSER FLY CONSTRUCTION

[76] Inventor: Alex J. Barna, 1216 Crawford St., Duquesne, Pa. 15110

[21] Appl. No.: 250,014

[22] Filed: Apr. 1, 1981

Related U.S. Application Data

[63] Continuation-in-part of Ser. No. 128,903, Mar. 10, 1980, Pat. No. 4,259,750.

[51] Int. Cl.[3] ..... A41D 1/06

[52] U.S. Cl. ..... 2/234; 2/243 R

[58] Field of Search ..... 2/234, 227, 79, 228, 2/235, 237, 243 R, 221

[56] References Cited

U.S. PATENT DOCUMENTS

| | | | |
|---|---|---|---|
| 1,832,687 | 11/1931 | Boshnack | 2/234 |
| 2,206,505 | 1/1939 | Klein | 2/237 |
| 2,285,692 | 6/1942 | Wickman | 2/227 |
| 2,396,446 | 6/1944 | Stein | 2/152 A |
| 2,585,175 | 2/1952 | Rosenberg | 2/234 |
| 2,726,397 | 5/1952 | Stirton | 2/48 |
| 2,971,200 | 2/1961 | Lindsey | 2/234 X |
| 3,085,247 | 10/1953 | Bixby | 2/46 |
| 3,092,840 | 6/1963 | Roberts | 2/234 |
| 3,110,903 | 6/1960 | Burchard | 2/221 |

*Primary Examiner*—H. Hampton Hunter

*Attorney, Agent, or Firm*—Stanley J. Price, Jr.; John M. Adams

[57] ABSTRACT

A trouser construction includes a conventional fly portion formed by a pair of overlapping flaps integral with the trouser waist and including a conventional zipper-type fly closure. In one embodiment, a second or imitation fly portion is removably attached to the waist portion in overlying relation with the conventional fly to simulate the appearance of the trousers being worn with the fly in an open position. In a second embodiment, an imitation fly portion is sewn onto the outer trouser flap that conceals the zipper of the operative fly of the trouser. The imitation fly portion includes a pair of strips of material each supporting a zipper-type track. The strips of material are sewn together and positioned in overlying relation with the trouser flap thereby concealing the trouser flap. The pair of zipper tracks extend from the upper end of the trouser flap to a lower end where the tracks converge toward one another and meet at a slide portion which engages the zipper tracks. Thus the row of zipper tracks are positioned in spaced relation and converge toward the lower end of the flap. The slide portion is also positioned at the lower end of the flap. With this arrangement an imitation open fly construction is formed overlying and concealing the conventional trouser fly.

10 Claims, 22 Drawing Figures

TROUSER FLY CONSTRUCTION

CROSS REFERENCE TO RELATED APPLICATION

This application is a continuation in part of co-pending prior application, Ser. No. 128,903 filed Mar. 10, 1980 and entitled "Trouser Fly Construction" now U.S. Pat. No. 4,259,750, dated Apr. 7, 1981.

BACKGROUND OF THE INVENTION

1. Field of the Invention

This invention relates to an article of wearing apparel and a method of making the same and more particularly to a trouser fly construction that includes an imitation fly portion secured in overlying and concealing arrangement with the flap of a trouser fly to present the appearance when the trousers are worn that the fly portion is in an open position.

2. Description of the Prior Art

It is well known in the art of wearing apparel to modify the construction of trousers and the like to enhance the utility of the wearing apparel and provide multiple uses or varied ornamental appearances of the wearing apparel. For example, U.S. Pat. Nos. 2,585,175 and 2,206,505 disclose trousers having modifications to the waist portion and fly portion which in one case facilitates waist adjustability while preserving a neat appearance of the trousers, particularly the waist and fly portions, and in another case modifies the trouser construction to ensure support on the wearer while participating in athletic activity.

U.S. Pat. No. 1,832,687 discloses a trousers closure which permits rapid opening and closing of the trousers. U.S. Pat. No. 2,285,692 discloses overalls for welders that includes a crotch structure that provides for wider than the normal spacing between the legs of the overalls at the crotch so that excess material is provided for added room and flexibility. A crotch piece and a slide fastener are covered at the front of the overalls by a fly that depends downwardly over the crotch structure for shedding sparks.

U.S. Pat. No. 2,971,200 discloses a slide fastener construction in which a main "zipper" is positioned between auxiliary "zippers". If the main zipper should become inoperative due to wear or for other reasons, then the unit is detached by the auxiliary zippers and readily replaced by a similar unit that is operative.

It is also known to provide outer garments constructed to provide freedom of action and present a neat appearance while engaging in athletic sports. An example of such an outer garment is disclosed in U.S. Pat. No. 3,110,903 which uses a plurality of conventional slide fasteners, such as the well-known "zipper", with garments for men and women in which the garment is quickly converted from a fashion garment for working hours to a sport garment which provides the free action construction desirable in athletics sports.

Attachments to articles of wearing apparel and devices for removably engaging one item of wearing apparel with another item are also well-known in the art as exemplified by U.S. Pat. Nos. 2,396,446 and 3,085,247. These patents disclose attachments to the conventional necktie for use as a necktie protector and clips associated with the necktie for attaching it to the neck band or shirt. These devices include fastening means associated with the knot portions of bow ties, as well as, conventional for-in-hand ties.

It is also a known practice to decorate articles of clothing by permanently attaching some form of decoration to the basic article. Removably attaching a novel or decorative item to wearing apparel to facilitate the removal or interchange of decorative and novelty items on wearing apparel is disclosed in U.S. Pat. No. 2,726,397.

U.S. Pat. No. 3,092,840 discloses an attachment to a garment to seal the garment openings against the entrance of extraneous matter. The attachment includes a garment sealing flap that is attachable to the button positioned, for example, at the neck band of a shirt or the like. The flap is turned back to overlie the shirt as the outer garment and over the exposed upper edge portions of additional garments worn beneath the outer garment.

There is need to provide conventional items of wearing apparel, such as trousers and the like, with attachments of a decorative and novel subject matter which can be conveniently worn with the trousers or removed therefrom according to the desires of the wearer.

SUMMARY OF THE INVENTION

In accordance with the present invention there is provided an article of wearing apparel that includes a trouser construction including a waist portion with a fly attached thereto. Closure means associated with the fly for opening and closing the fly. A flap portion is connected to the waist portion for movement into and out of position overlying the closure means. The flap portion has an outer surface and an inner surface overlying the closure means to conceal the closure means when the fly is closed. Imitation closure means is secured to the flap portion outer surface for simulating the appearance of the trouser construction having the fly in an open position. The imitation closure means includes fastener elements secured to the flap portion outer surface in spaced relation to form with the flap portion an imitation open fly construction overlying and concealing the fly.

Further in accordance with the present invention there is provided a method of making a trouser construction including the steps of positioning a zipper assembly on the outer surface of a trouser flap portion that overlies and conceals a trouser fly. A pair of material strips each supporting a row of zipper teeth of the zipper assembly are twisted. The twisted material strips are positioned in abutting relation and between the rows of zipper teeth extending the length of the strips of material. The abutting material strips are secured to the outer surface of the trouser flap portion. The rows of zipper teeth extend in spaced relation from the upper ends of the rows of zipper teeth toward one another to the lower end of the rows of zipper teeth at the bottom of the trouser flap portion to simulate a trouser fly in an open position.

In one embodiment the fastener elements include a pair of track portions and a slide portion. The slide portion engages both track portions at the lower end thereof to simulate the trouser construction having an open fly.

Further, the fastener elements include a pair of engageable zipper-type track portions positioned in spaced relation on a pair of strips of material respectively. A slide portion is connected to the strips of material at one end thereof and engageable with the track portions. The slide portion is movable the length of the strips of material to bring the track portions into and out of meshing engagement. The strips of material are connected to each other the length thereof and are positioned on the flap portion outer surface so that the track portions converge toward one another from the upper ends of the strips of material to the slide portion positioned at the lower ends of the strips of material to simulate an open fly.

Preferably the strips of material are sewn onto the flap outer surface and extend substantially the length of the flap portion. A fastener is positioned at the lower ends of the strips of material opposite the lower end of the flap portion. The fastener engages the pair of track portions at the end thereof urging the track portions to converge from a parallel relation to a tapered relation at the lower end of the flap portion. The fastener has means for engaging the pair of track portions to draw the pair of track portions toward one another for engaging the flap portion outer surface.

In another embodiment, the zipper-type track portions include a plurality of spaced apart teeth. The track portions are secured to the flap outer surface by sewing the spaced apart teeth to the flap portion outer surface so that the track portions converge toward one another from the upper end thereof to a slide positioned at the lower ends of the zipper track portions. A slide portion engages the teeth of one tract portion in meshing relation with the teeth of the other track portion. The slide portion is maintained at the lower ends of the zipper track portions to present the appearance of the trouser fly in an open position.

Accordingly, the principal object of the present invention is to provide an article of wearing apparel that includes a trouser construction having an imitation fly positioned in overlying relation with the conventional fly of a trouser in a manner that simulates the appearance that the trouser having an open fly where in fact the actual fly of the trouser is closed and concealed beneath the imitation fly.

Another object of the present invention is to provide an article of wearing apparel that includes a pair of overlying fly portions secured integrally with the trouser construction where a first fly is provided for conventional operation and a second fly is provided in overlying relation with the first fly in a manner to create the impression that the trouser construction is worn with the fly open.

Another object of the present invention is to provide a method of making a trouser construction that includes the positioning and sewing of a conventional zipper to the flap of a trouser in overlying and concealing relation with the conventional fly of the trouser in a manner to give the impression that the trouser is being worn with an open fly.

These and other objects of the present invention will be more completely disclosed and described in the following specification, the accompanying drawings, and the appended claims.

DESCRIPTION OF THE PREFERRED EMBODIMENTS

Figure 1:
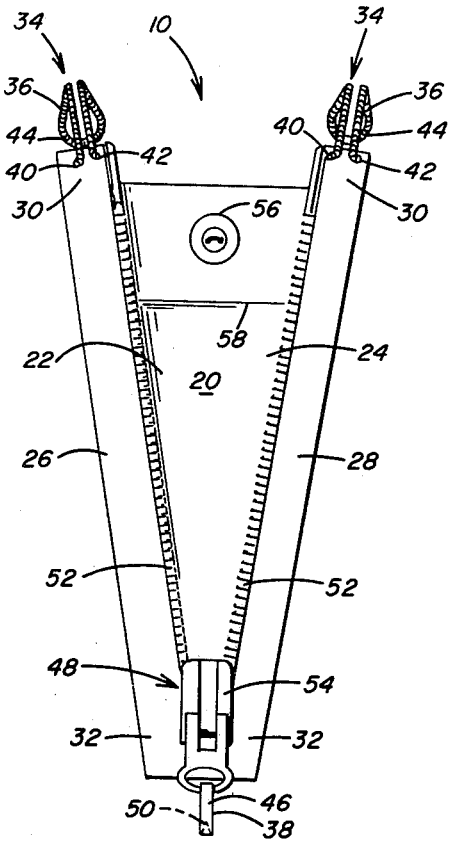
FIG. 1 is a plan view of a removable fly construction adapted to be attached in overlying relation with the conventional fly of a pair of trousers.
Figure 2:
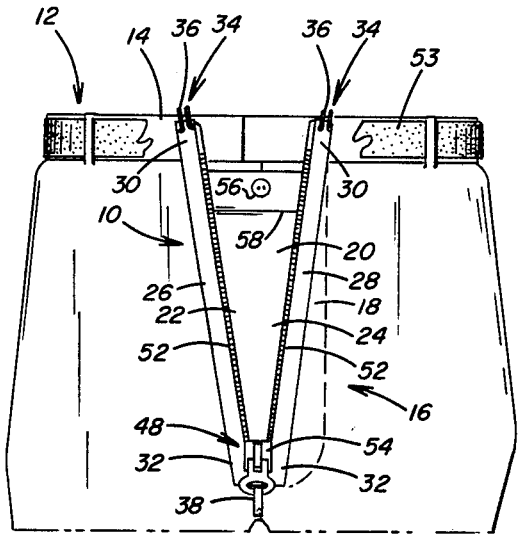
FIG. 2 is a fragmentary schematic view in elevation of one embodiment of a trouser construction, illustrating the removable fly construction shown in FIG. 1 secured to the trouser construction to present the appearance that the trousers are worn with the fly in an open position.
Figure 3:
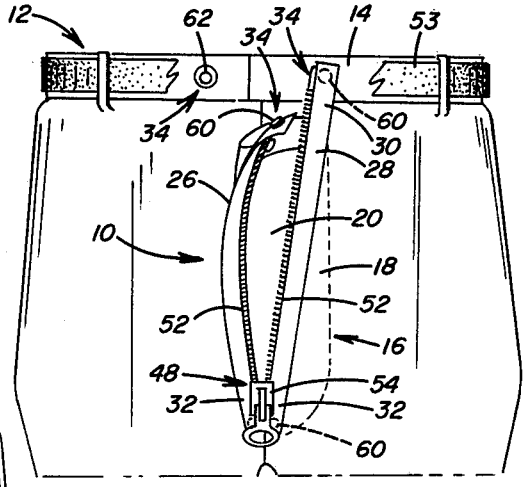
FIG. 3 is a fragmentary schematic view in elevation similar to FIG. 2, illustrating cooperating snaps on the trouser construction and the removable fly.

Referring to the drawings and particularly to FIGS. 1–3 there is illustrated an attachment generally designated by the numeral 10 for releasable engagement with trousers 12 of a conventional construction having a waist portion 14 and a conventional fly portion 16 formed integrally with the waist portion 14. The fly portion 16 includes a pair of overlapping flaps. A first flap 18 overlies a second flap (not shown) so that the second flap is concealed by the first flap 18 when the trousers are worn in a conventional manner.

The integral fly portion 16 also includes a conventional fastener (not shown) such as a zipper construction having two rows of teeth on strips of tape which are sewn to the respective flaps and a sliding piece that closes the opening between the flaps by drawing the teeth into meshing relation. This construction is well known in the art. The attachment 10 is removably connected to the trousers 12 in overlying relationship with the fly portion 16 so that when worn on the trousers 12 it presents an appearance or illusion that the trousers are being worn with the fly in an open position where in fact the fly portion 16 is closed and the attachment 10 is a false or imitation fly.

As illustrated in FIG. 1 the attachment 10 is constructed to appear as a fly portion of trousers in an open position. FIG. 2 illustrates the attachment or second fly portion 10 secured in overlying relation with the conventional, first fly portion 16 of the trousers 12. The attachment or second fly portion 10 includes a flexible backing 20 having a pair of elongated side edges 22 and 24. A pair of strips 26 and 28 are secured in a suitable manner in overlying relation with the side edges 22 and 24 respectively.

Each of the strips 26 and 28 includes an upper end portion 30 and a lower end portion 32. The strips 26 and 28 are positioned on the backing 20 with the upper end portions 30 spaced a greater distance apart than the lower end portions 32. With this arrangement the strips 26 and 28 converge toward one another in a direction from the upper end portions 30 to the lower end portions 32.

The attachment or second fly portion 10 is releasably engageable with the trousers 12 in overlying relation with the fly portion 16 that is formed integral with the trousers 12. The attachment 10 is connected to the trousers 12 by engaging devices generally designated by the numeral 34 in FIGS. 1–4. As illustrated in FIGS. 1 and 2 the engaging devices 34 include in one embodiment a pair of hooks 36 secured to the strip upper end portions 30 and a hook 38 attached to the removable fly portion 10 to extend below the strip lower end portions 32.

The pair of hooks 36 are preferably constructed of a flexible wire-like material. Each of the hooks includes individual end portions 40 and a looped end portion 44. The hook 38 is a substantially rigid member having a shank portion 46 which is suitably connected to a fastener device generally designated by the numeral 48. The shank portion 46 terminates in an in-turned, prong-like end portion 50. The pronged end portion 50 is adapted to embed into the material comprising the trousers 12.

In accordance with the present invention the fly construction 10 of FIG. 1 is adaptable to be releasably secured to the trousers 12 in the position illustrated in FIG. 2. With the fly portion 16 of the trousers 12 in a closed position, the fly construction 10 is positioned in overlying relation with the fly portion 16. The pair of hooks 36 are looped over the waist portion 14 so that the waist portion 14 is positioned between the looped end portions 44 on the inside of the waist portion 14 and the ends 40 and 42 engaging the outside of the waist portion 14. The hooks 36 in this position are compressed to frictionally engage the waist portion 14 thereby securing the upper end portions 30 of the strips 26 and 28 to the trousers 12.

With the fly construction 10 secured to the trousers 12, the flexible backing 20 and strips 26 and 28 extend downwardly to lie substantially on the first flap 18 of the fly portion 16. The lower hook 38 extends downwardly so that the pronged end portion 50 engages the trousers 12. With this arrangement, the fly construction 10 is fully extended to lie flat on the trousers fly portion 16.

When the fly portion 10 is positioned on the trousers 12, a belt 53 when worn with the trousers 12 overlies the strip upper end portions 30 and the pair of hooks 36. This arrangement conceals the manner in which the attached fly construction 10 is mounted on the trousers 12. Also with the pronged end portion 50 being turned inwardly it is not readily apparent that the lower end of the fly construction 10 is removably connected to the trousers 12.

The fastener device 48 includes the basic components of a conventional zipper-type fastener. A track or row of teeth 52 are suitably secured to the edges of the strips 26 and 28 that overly the backing side edges 22 and 24. A slide portion 54 is positioned at the strip lower end portions 32 and engages the row of teeth 52. In this position of the slide portion 54, the fly construction 10 is in an open position.

In accordance with the present invention the removable fly construction 10 is maintained in the open position on the trousers 12, as illustrated in FIG. 2, to simulate the appearance that the trousers 12 are being worn with the fly in an open position. However, the conventional fly portion 16 of the trousers 12 is closed; while, the removable fly construction 10 presents a false impression that the fly is open.

Further in accordance with the present invention the flexible backing 20 preferably includes a cloth material having a uniform construction throughout. Preferably, the cloth backing 20 has a color, texture, and design which contrasts visibly with the trouser construction, color, and design so that the backing 20 is clearly distinguishable from the trousers 12. Further the cloth backing 20 may also include suitable ornamentation such as a button 56 stitched to the upper end of the backing 20 and further a border 58 extending below and spaced from the button 56. This arrangement is intended to simulate the appearance that the trousers 12 are being worn with the fly portion open and the garment worn underneath the trousers exposed.

Not only can the removable fly construction 10 be secured to the trousers 12 by the hooks 36 and 38 but cooperating snap devices 60 and 62 can also be utilized as illustrated in FIG. 3. The snap devices 60 are secured to the fly construction 10 and are removably engageable with the corresponding snap devices 62 provided on the trousers waist portion 14. Pairs of cooperating snap devices 60 and 62 secure the strip upper end portions 30 to the waist portion 14. A snap device 60 is also secured to the underside of the backing 12 opposite the slide portion 54 for engagement with a cooperating snap device (not shown) secured to the trousers 12. Thus when the cooperating snap devices 60 and 62 are engaged the removable fly construction 10 is positioned in overlying relationship with the trousers fly portion 16 to conceal the fly portion 16.

Figure 4:
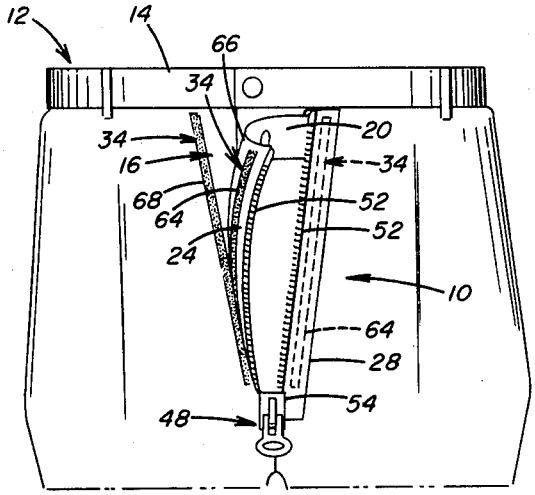
FIG. 4 is another view similar to FIG. 3, illustrating the removable fly construction attached to the trousers by interlocking Velcro strips.

Further in accordance with the present invention the removable fly construction 10 is releasably secured to the trousers 12, as illustrated in FIG. 4, by cooperating Velcro closure strips on the fly construction 10 and the trousers 12. The construction of Velcro-type closures is well known and described in detail in U.S. Pat. Nos. 3,054,400 and 3,376,865 which are incorporated herein by reference.

A first pair of Velcro strips 64 are secured to the undersurface 66 of the backing 20. A corresponding pair of Velcro strips 68 are suitably secured to the fly portion 16 of the trousers 12. When the removable fly construction is positioned on the trousers fly portion 16 the Velcro strips 64 of the backing 20 engage the Velcro strips 68 of the trousers 12. In this manner the removable fly construction 10 is maintained in the desired position on the trousers 12 to create the appearance that the trousers are being worn with the fly open.

Figure 5:
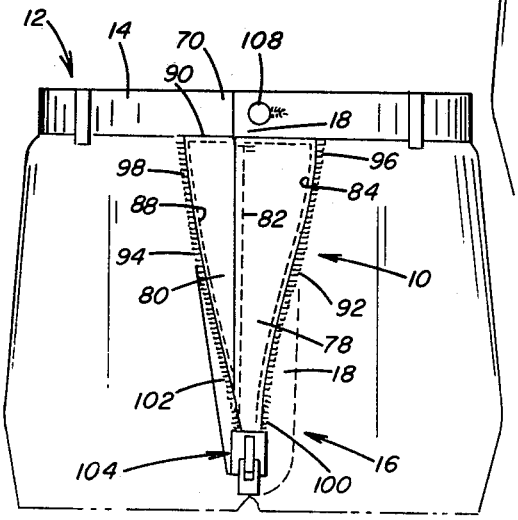
FIG. 5 is a fragmentary schematic elevation of a second embodiment of a trouser construction, illustrating an outer or imitation fly integrally secured to the conventional fly to present the appearance when the trousers are worn of the fly in an open position exposing the undergarment.
Figure 6:
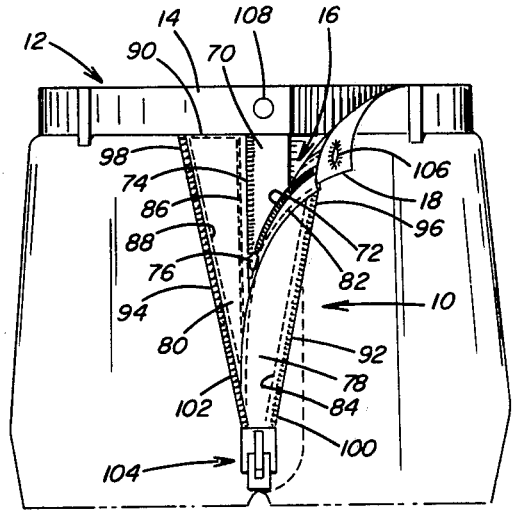
FIG. 6 is a further fragmentary schematic elevation with the trouser construction shown in FIG. 5, illustrating the outer or imitation fly sewn to the conventional fly which is concealed by the outer fly.

Now referring to FIGS. 5 and 6 there is illustrated another embodiment of the present invention in which the second or imitation fly construction 10 is formed integral with the trousers 12 and is supported by the conventionally operative fly portion generally designated by the numeral 16 of the trousers 12. As well known, the conventional fly portion 16 of the trousers 12 includes a first or upper flap 18 and a second or lower flap 70. The upper and lower flaps 18 and 70 are conventionally attached to the waist portion 14 and are movable relative to each other to open and close the fly portion 16.

As illustrated in FIG. 6, the fly portion 16 includes a conventional slide fastener comprising a row of teeth or track elements 72 beneath the upper flap 18 and a row of teeth or track elements 74 attached to the lower flap 70. The cooperating track elements 72 and 74 are moved into and out of meshing relation by a slide 76. FIG. 6 illustrates the conventional fly portion 16 in a partially open position. To close the fly portion 16 the slide 76 is advanced on the track elements 72 and 74 to a raised position adjacent the trouser waist portion 14.

To obtain the desired illusionary effect of the trousers being worn with the fly portion in an open position, the second or imitation fly portion 10 is secured to the upper flap 18 and the lower flap 70. The backing for the imitation fly portion 10 in FIG. 6 includes a first backing portion 78 and a second backing portion 80. The first backing portion 78 is secured to the upper flap 18 and the second backing portion 80 is secured to the lower flap 70.

The first backing portion 78 is folded over the upper flap 18 and is stitched along an edge 82 on the undersurface of the upper flap 18 adjacent the track elements 72. The outer edge of the first backing portion 78 is stitched to the outer surface of the upper flap 18 along an edge 84. In this manner the first backing portion 78 of the imitation fly portion 10 is formed integral with the upper flap 18 of the conventionally operating fly portion 16 of the trousers 12. Similarly, the second backing portion 80 of the imitation fly portion 10 is stitched to the lower flap 70 along an edge 86 adjacent the track elements 74 and also is stitched along an edge 88 and an edge 90 to the lower flap 70.

The imitation fly portion 10 illustrated in FIGS. 5 and 6 also includes teeth or track elements 92 and 94 sewn in a conventional manner to the outer edges of the first backing portion 78 and the second backing portion 80. The track elements 92 and 94 are positioned on the first and second backing portions 78 and 80 with upper end portions 96 and 98 spaced a greater distance apart than lower end portions 100 and 102. With this arrangement, the track elements 92 and 94 converge toward one another in a direction from the upper end portions 96 and 98 to the lower end portions 100 and 102. A fly closure device or fastener generally designated by the numeral 104 is secured to and supported by the track elements lower end portions 100 and 102. Preferably, the fly closure device 104 is retained in a lowermost position as illustrated in FIGS. 5 and 6 to simulate the appearance that the trousers fly is in an open position.

As illustrated in FIG. 5 when the trousers 12 are worn with the conventional fly portion 16 in a closed position, the upper and lower flaps 18 and 70 are positioned in overlapping relation. The button hole 106 engages the button 108 at the waist portion 14. The second or imitation fly portion 10 is then positioned to give the impression that the trousers 12 are being worn with the fly portion thereof in an open position. However, in fact the conventional fly portion 16 and the elements thereof, i.e. the track elements 72 and 74 and the slide 76, are concealed by the respective backing portions 78 and 80 of the imitation fly portion 10.

Figure 7:
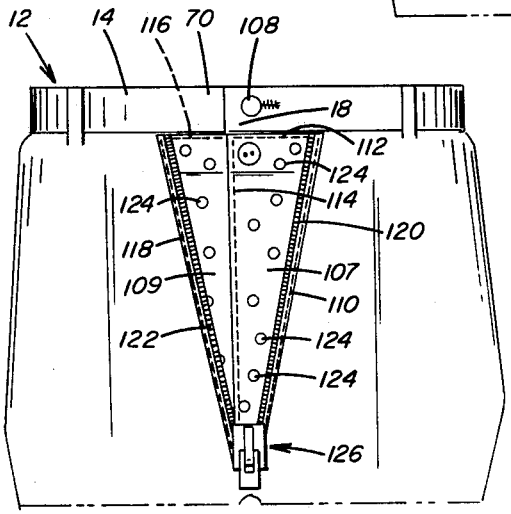
FIG. 7 is a fragmentary schematic elevation of a third embodiment of a trouser construction, illustrating an outer or imitation fly formed by a fabric having the image of a trouser fly thereon and sewn to the trousers over the conventional fly to present the appearance that the trousers are being worn with an open fly.

The present invention also includes the provision, as illustrated in FIG. 7, of an imitation fly 10 formed integral with the trousers 12 similar to the embodiment illustrated in FIGS. 5 and 6 where the imitation fly 10 is formed by material having the image of a trouser fly appearing thereon. The image can be formed by any suitable photographic process. Also, the design of a fly construction can be formed on fabric material by silk screen printing and the printed fabric sewn onto the trousers. This is accomplished, as shown in FIG. 7, by attaching in the same manner as above discussed to the first and second flaps 18 and 70 of the trousers 12 backing portions 107 and 109. The backing portion 107 is stitched along the edges 110, 112, and 114 to the upper flap 18. The backing portion 109 is stitched along the edges 116 and 118 to the lower flap 70.

The backing portions 107 and 109 are printed with the image of track elements 120 and 122. The backing portion 107 includes the image of a fly closure device 126. This construction, as illustrated in FIG. 7, gives the appearance that the fly portion of the trousers is in an open position.

To further simulate the appearance of an open fly for the trousers, the respective backing portions 107 and 109 may be fabricated of a suitable material that markedly contrasts with the fabric of the trousers 12. For example the backing portions 107 and 109 may have a color clearly distinguishable from the color of the trousers 12. The backing portions 107 and 109 may also include a design such as a plurality of dots 120 as illustrated in FIG. 7.

The appearance of the backing portions 107 and 109 is preferably chosen to give the appearance that the garment which is worn under the trousers 12 is exposed as would occur if the fly portion of the trousers were actually worn in an open position. This effect enhances the illusion created by the imitation fly construction 10 on the trousers 12. Thus it will be apparent that the design of the imitation fly construction 10 is selective as determined by the use made of the trouser construction as for example in dramatic or novelty applications where the present invention is particularly adaptable.

Referring now to FIGS. 8–12, there is illustrated in accordance with the present invention an embodiment in which an imitation closure device generally designated by the numeral 128 is secured by sewing to the first or outer flap 18 of the trousers 12. The imitation closure device 128 is preferably a conventional "zipper" formed by a pair of track portions 130 and 132 as illustrated in detail in FIGS. 10–12. The track portions 130 and 132 are supported by a pair of strips 134 and 136 material. The track portions 130 and 132 include a plurality of spaced apart "zipper" teeth 138.

As well known in the art the teeth 138 are engageable in meshing relation to connect the zipper track portions 130 and 132 in a conventional manner to close the zipper by operation of a fly closure device, such as a slide portion generally designated by the numeral 140. Also as conventionally known the slide portion 140 includes an actuator 142 which for purposes of ornamentation supports a ring member 144 for moving the actuator 142 up and down on the strips of material 134 and 136 to move the "zipper" teeth 138 into and out of meshing engagement as well known in the art.

The closure device 128 is a commercially available product that is utilized in the apparel art to construct a zipper for an article of wearing apparel. However, with the present invention the device 128 is secured to the trouser flap 18 solely for the purpose of creating the impression that the trousers are worn with the fly portion 16 in an open position where in fact the fly portion is closed and concealed by the outer flap 18. Thus in accordance with the present invention the closure device 128 is secured to the trouser outer flap 18 in a non-functional manner.

The slide portion 140 is maintained in a lowermost position engaging the lower ends of the track portions 130 and 132 on the strips of material 134 and 136. The track portions 130 and 132 forming the fastener elements of the closure device 128 are secured to an outer surface 146 of the flap portion 18. The flap portion 18 also includes an inner surface (not shown). When the trousers are worn and the conventional fly 16 is closed, the inner surface of the flap portion 18 overlies the conventional and operative closure device "zipper" associated with the trouser fly 16. Thus when the trousers 12 are worn in a conventional manner, the fly 16 is concealed by the flap 18.

Figure 10:
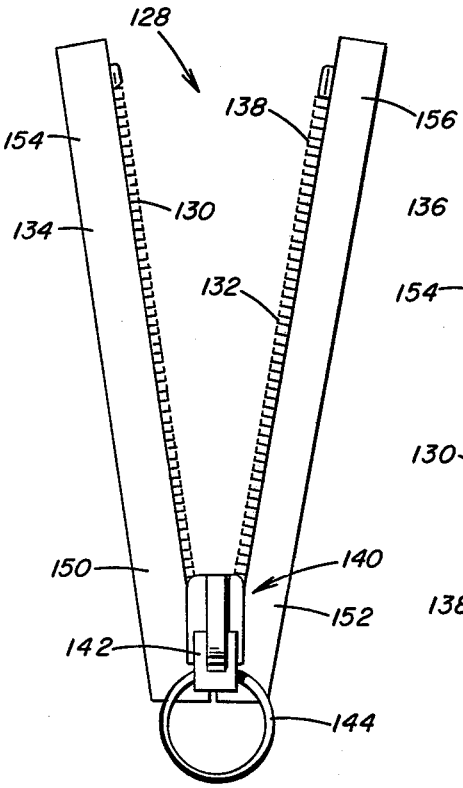
FIGS. 10–12 are schematic plan views of the construction of the imitation zipper-type fly sewn to the outer flap of the trouser shown in FIGS. 8 and 9, illustrating the method of adapting the zipper for attachment to the outer flap of the trouser to imitate a fly in a open position.
Figure 11:
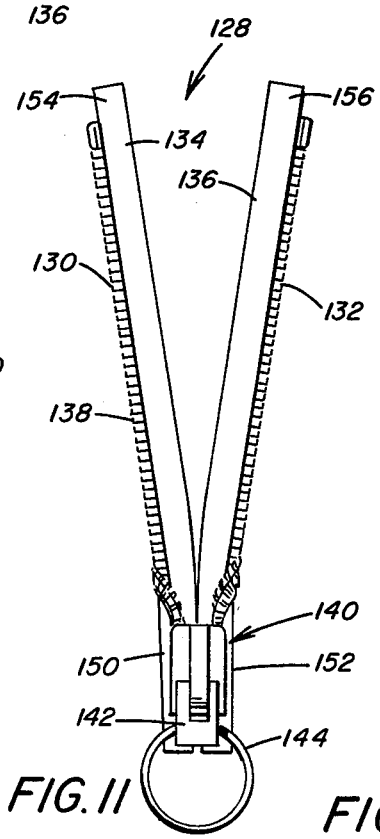
Figure 12:
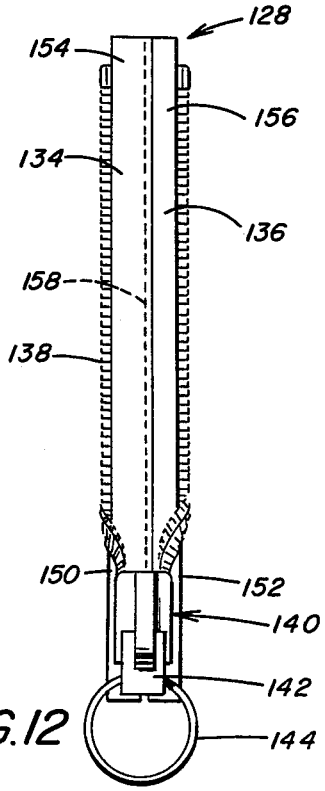

The closure device 128 is secured by the flap 18 in a manner as illustrated in FIGS. 10–12 to simulate the appearance of the trouser construction 12 having the fly 16 in an open position. This is accomplished by the selective positioning of the closure device 128 in the form of a conventional "zipper" on the trouser flap outer surface 146. The closure device 128 is initially positioned, as illustrated in FIG. 10, with the slide portion 140 engaging the track portions 130 and 132 at the lower ends 150 and 152 of the strips 134 and 136, respectively. The upper ends 154 and 156 are spaced apart so that the track portions 130 and 132 converge toward one another from the upper ends 154 and 156 to the slide portion 140 positioned at the lower ends 150 and 152 of the strips of material 134 and 136.

The strips of material 134 and 136 are twisted from the position illustrated in FIG. 10 to the position illustrated in FIG. 11 where the strips 134 and 136 are adjacent to one another in comparison with the position illustrated in FIG. 10 where the track portions 130 and 132 are positioned between the strips 134 and 136. In FIG. 11 the rows of "zipper" teeth 138 are located on the outer lateral edges of the strips 134 and 136. This permits the strips to be moved into abutting relation as illustrated in FIG. 12.

Figure 8:
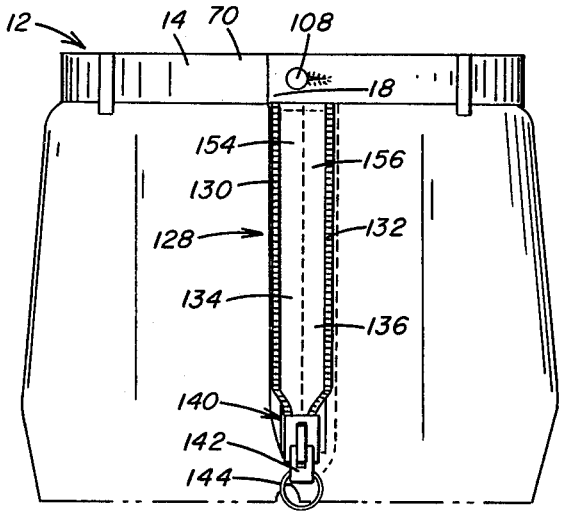
FIG. 8 is a fragmentary schematic view in elevation of a further embodiment of a trouser construction, illustrating an imitiation fly sewn to the trouser flap that overlies the conventional fly and being formed by a pair of zipper-type track portions supported by strips of material on the trouser flap.
Figure 9:
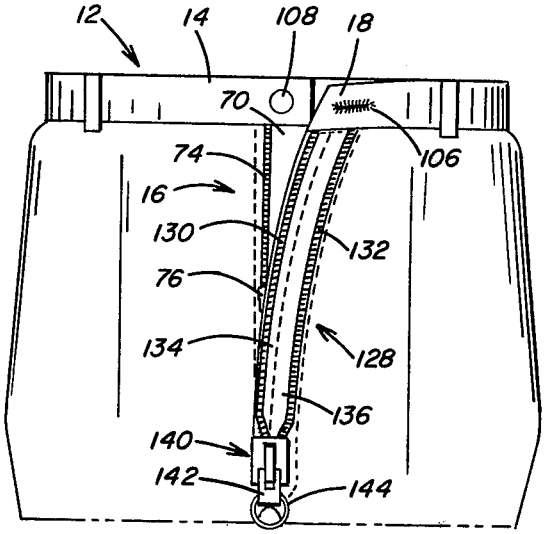
FIG. 9 is a fragmentary schematic view in elevation of the embodiment of the trouser construction shown in FIG. 8, illustrating the conventional zipper-type fly positioned in underlying relation with the imitation zipper-type fly.

The strips of material 134 and 136 are maintained in abutting relation by securing them as by sewing as indicated by the dotted line 158 in FIGS. 8, 9, and 12. By twisting the strips of material 134 and 136 and the track portions 130 and 132 and securing them together, the track portions 130 and 132 extend in spaced relation from the upper ends 154 and 156 toward one another at the lower ends 150 and 152. In this manner, the "zippers" 138 converge toward the slide portion 140.

Once the closure device 128 is assembled in the manner illustrated in FIG. 12, the closure device 128 is attached in a conventional manner, as by sewing, to the outer flap 18 of the trousers 12 as illustrated in FIGS. 8 and 9. Thus the closure device 128 substantially conceals the outer flap 18 to imitate the conventional closure of the trousers 12 in an open position. The track portions 130 and 132 extend in a spaced parallel relation from the strip upper ends 154 and 156 to a converging or tapered relation at the strip lower ends 150 and 152. This arrangement creates the illusion of the trousers 12 with an open fly. However, the conventional fly 16 concealed beneath the imitation fly 12 remains operable; while, the imitation fly 128 presents the appearance of the trousers 12 being worn with an open fly.

Figure 13:
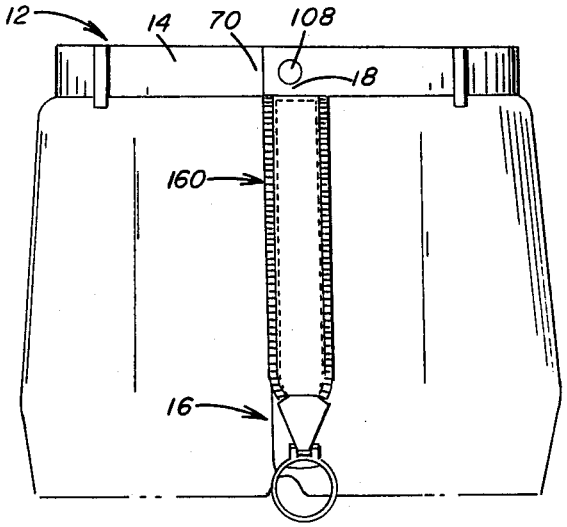
FIGS. 13 and 14 are fragmentary schematic elevations of an additional embodiment of a trouser construction similar to the trouser construction shown in FIGS. 8 and 9, illustrating a pair of zipper track portions supported by a strip of material on the outer trouser flap with an imitation fastener engaging the track portions to create the image of an open fly.
Figure 14:
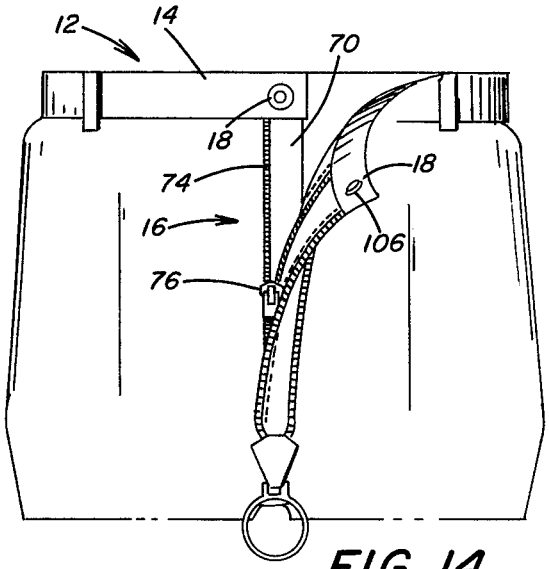
Figure 15:
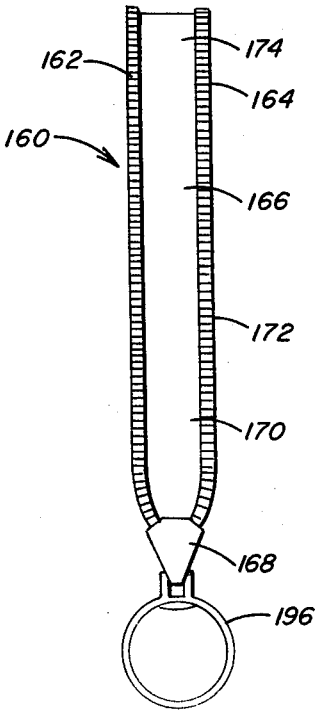
FIG. 15 is a schematic view in elevation of the zipper construction adapted for securing to the outer flap of the trouser construction as illustrated in FIGS. 13 and 14.

Not only may the imitation fly be formed by the conventional "zipper" as illustrated and discussed with regard to FIGS. 8–12, but an imitation fly generally designated by the numeral 160 in FIGS. 13–15 can be artificially constructed. The imitation fly 160 is also secured to the outer flap 18 of the trousers 12. The imitation fly 160 as illustrated in FIG. 14 overlies the conventional fly 16 which remains operational. The imitation fly 160 includes a pair of zippertype track portions 162 and 164 positioned in spaced relation on and supported by a strip of material 166. The track portions 162 and 164 extend in spaced parallel relation the length of the strip of material 166, as illustrated in FIG. 16.

Figure 16:
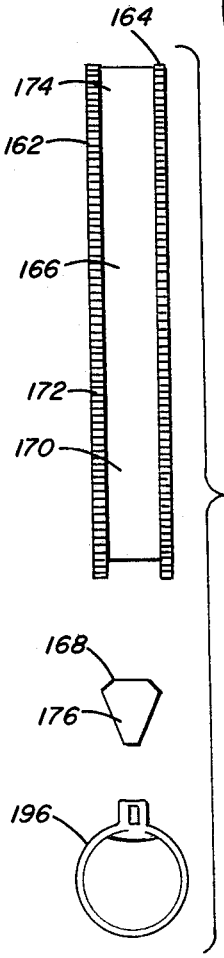
FIG. 16 is an exploded view in elevation illustrating the components of the zipper construction shown in FIG. 15.
Figure 19:
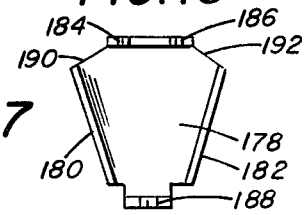
FIG. 19 is a rear view of the fastener shown in in FIG. 18.

A fastener 168 having a triangular configuration as illustrated in detail in FIGS. 16 and 19 is positioned on the strip of material 166 at a lower end 170 thereof and in engagement with individual "zipper" teeth 172 of the track portions 162 and 164 at the lower end 170. In this manner, the track portions 162 and 164 converge from a parallel relation at an upper end 174 of the strip 166 to a tapered relation at the lower end 170 where the fastener 168 is positioned. The fastener 168 is constructed to engage the zipper teeth 172 at the lower ends of the track portions 162 and 164 to draw together the track portions 162 and 164, as illustrated in detail in FIG. 15.

Figure 17:
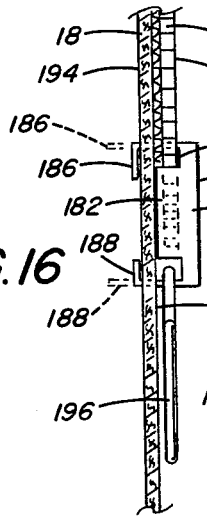
FIG. 17 is a fragmentary view in elevation of the lower end of the zipper construction positioned on the trouser outer flap, shown in FIG. 13, illustrating an imitation zipper actuator.
Figure 18:
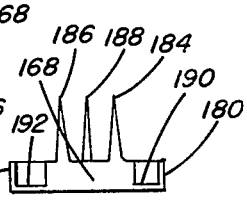
FIG. 18 is a top plan view of the fastener adapted for connection to the outer flap of the trouser and engageable with the lower end of the zipper tracks.

Now referring to FIGS. 17–19 there is illustrated in greater detail the construction of the fastener 168 which is selectively fabricated to engage the track portions 162 and 164 at the lower end 170 of the strip of material 166. The fastener 168 is fabricated of a preselected material, such as metal or plastic, and includes an outer surface 176 and an inner surface 178. The inner surface 178 is positioned in opposed relation with the strip of material 166. Extending laterally from the inner surface 178 are a pair of flanges 180 and 182. Extending rearwardly from the upper and lower edges of the inner surface 178 are a plurality of prongs 184, 186, and 188. Separating the flanges 180 and 182 from the prongs 184 and 186 are a pair of openings 190 and 192.

With the above-described arrangement, the fastener 168 is secured to the zipper track portions 162 and 164 by positioning the oppositely aligned zipper teeth 172 at the lower end 170 of the strip of material 166 in the recessed openings 190 and 192, as illustrated in FIG. 17. The lower ends of the zipper track portions 162 and 164 are thus concealed by the fastener 168. The track portions 162 and 164 extend through the fastener openings 190 and 192 and are thus directed toward one another in a converging arrangement toward the fastener 168. This arrangement simulates a zipper of a fly in an open position.

In order to attach the fastener 168 to the lower end 170 of the material strip 166 in engagement with the track portions 162 and 164, the prongs 184, 186 and 188 are extended through the material of the outer flap 18 of the trousers 12 as indicated in phantom in FIG. 17. The prongs 184, 186, and 188 are then bent toward one another into overlying relation with the inner surface 194 of the trouser flap 18. This secures the fastener to the outer surface 146 of the trouser flap 18. As illustrated in FIG. 17, the prongs 184 and 186 extend through the lower end 170 of the material strip 166 and through the trouser flap 18. The lower prong 188 engages the trouser flap 18 only.

To enhance the appearance of the imitation fly 160, an imitation zipper actuator 196 in the form of a ring is connected to the fastener 168 to overlie the trouser flap 18. The fastener lower prong 188 extends through the ring and into and through the trouser flap 18. The prong 188 is then bent to engage the flap inner surface 194. The zipper actuator 196 hangs downwardly from the fastener 168 below the zipper tracks 162 and 164. This creates the impression that the trousers 12 are being worn with the fly in an open position.

In the embodiment of the assembled imitation fly 160 illustrated in FIG. 15, the strip of material 166 is secured in overlying relation with the outer surface 146 in the trouser flap 18 by sewing the strip of material 166 to the trouser flap 18 as indicated by the dotted lines 198 in FIG. 13. With the strip of material 166 sewn to the trouser flap 18 and the fastener 168 secured by the prong 184, 186, and 188 to the trouser flap 18, the imitation fly 160 is securely positioned on the trouser flap 18. Thus when the conventional fly 16 of the trousers 12 is closed, as illustrated in FIG. 13, the imitation fly 160 generates the appearance that the trousers 12 are being worn with the fly in an open position.

Figure 20:
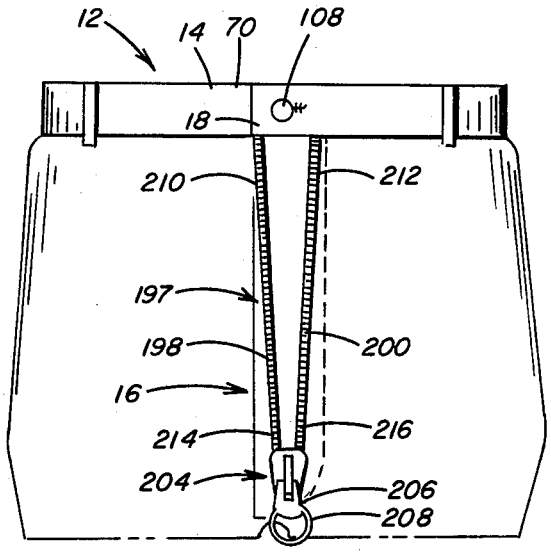
FIG. 20 is a fragmentary schematic elevation of a further embodiment of a trouser construction, illustrating an imitation fly secured to the outer flap of the trouser and being formed by a pair of zipper tracks sewn to the outer flap.
Figure 22:
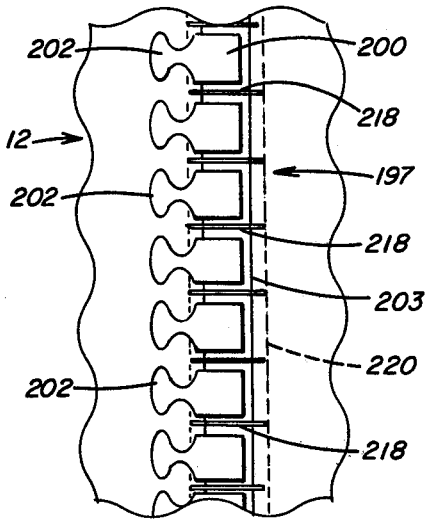
FIG. 22 is an enlarged fragmentary plan view of one of the zipper tracks of the zipper construction illustrated in FIGS. 20 and 21, illustrating the manner in which the zipper tracks are secured to the trouser outer flap.
Figure 21:
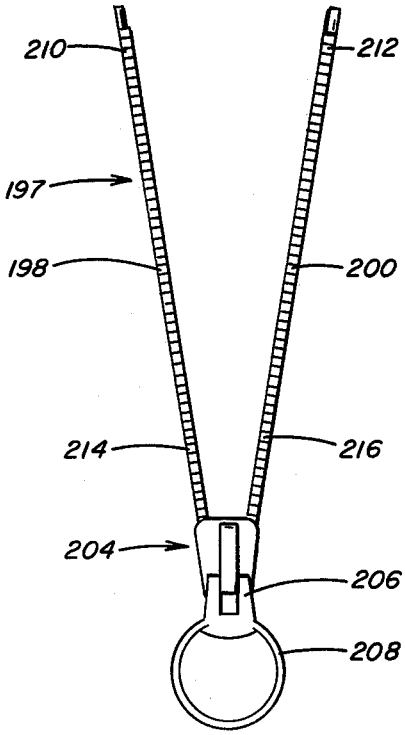
FIG. 21 is an enlarged top plan view of the zipper construction that is sewn to the trouser outer flap to imitate an open fly, as illustrated in FIG. 20.

Now referring to FIGS. 20–22 there is illustrated a further embodiment of an imitation fly generally designated by the numeral 197 that includes, as illustrated in detail in FIG. 21, a pair of zipper-track portions 198 and 200 formed by a plurality of spaced apart teeth 202. The teeth 202 shown in detail in FIG. 14 are supported by a thin strip of material 204 having a width less than the width of the respective teeth 202.

The imitation fly 197 is similar in construction to the imitation closure device 128 illustrated in FIG. 10 and is formed form an operable "zipper" that includes a conventional slide portion generally designated by the numeral 204 having an actuator 206 and a decorative ring 208. As with the imitation closure device 128 illustrated in FIG. 10, the "zipper" is operable by movement of the slide portion 204 to connect in meshing relation the teeth 202 of the track portion 198 with the teeth 202 of the track portion 200.

In accordance with the present invention the track portions 198 and 200 are maintained in a position where the upper ends 210 and 212 are spaced apart and the lower ends 214 and 216 converge. The teeth 202 engage one another at the lower ends 214 and 216. When secured to the trouser flap outer surface 146 as illustrated in FIG. 20, the imitation fly 197 simulates the appearance of the trouser 12 being worn with the trouser fly in an open position.

As illustrated in FIG. 22 the zipper track portions 198 and 200 are secured to the flap outer surface 146 in a suitable manner, for example, by sewing. The strips of material 203 support the individual teeth 202 of the track portions 198 and 200. The strips 203 are sewn to the trouser flap 18 as indicated by the thread seam lines 218 and 220. The portion of the strips of material 203 between adjacent teeth 202 are sewn to the trouser flap 18 so as to present a neat appearance of the imitation fly 197 on the trouser flap 18.

The track portions 198 and 200 are sewn to the trouser flap 18 so that the upper ends 210 and 212 are spaced apart and taper or converge toward one another down to the slide portion 204. The slide portion 204 is maintained as illustrated in FIG. 20 at the lower end of the trouser flap 18. Thus the imitation fly 197 is secured to the trouser flap 18 to form with the trouser flap an arrangement that presents the appearance of the trousers 12 worn with the fly in an open position.

According to the provisions of the patent statutes, I have explained the principle, preferred construction and mode of operation of my invention and have illustrated and described what I now consider to represents its best embodiments. However, it should be understood that, within the scope of the appended claims, the invention may be practiced otherwise than as specifically illustrated and described.

I claim:

1. An article of wearing apparel comprising, a trouser construction including a waist portion with a fly attached thereto, closure means associated with said fly for opening and closing said fly, a flap portion connected to said waist portion for movement into and out of position overlying said closure means, said flap portion having an outer surface and an inner surface overlying said closure means to conceal said closure means when said fly is closed, imitation closure means secured to said flap portion outer surface for stimulating the appearance of said trouser construction having said fly in an open position, and said imitation closure means including fastener elements secured to said flap portion outer surface in spaced relation to form with said flap portion an imitation open fly construction overlying and concealing said fly.

2. An article of wearing apparel as set forth in claim 1 in which, said fastener elements include a pair of track portions and a slide portion, and said slide portion engaging said pair of track portions at the lower ends thereof to simulate said trouser construction having an open fly.

3. An article of wearing apparel as set forth in claim 1 in which, said fastener elements include a pair of engageable zipper-type tract portions positioned in spaced relation, a pair of strips of material supporting said pair of track portions respectively, a slide portion connected to said strips of material a one end thereof and engageable with said track portions, said slide portion being movable the length of said strips of material to bring said track portions into and out of meshing engagement, and said strips of material being connected to each other the length thereof and positioned on said flap portion outer surface so that said track portions converge toward one another from an upper end of said strips of material to said slide portion positioned at a lower end of said strips of material to simulate an open fly.

4. An article of wearing apparel as set forth in claim 1 in which, said fastener elements include a row of zipper-type track portions positioned in spaced relation, a strip of material supporting said pair of track portions in a spaced parallel relation, said strip of material being sewn to said flap portion outer surface and extending substantially the length of said flap portion, a fastener positioned at the lower end of said strip of material opposite the lower end of said flap portion, said fastener engaging said pair of track portions at the ends thereof urging said tract portions to converge from a parallel relation to a tapered relation at the lower end of said flap portion, and said fastener having means for engaging said track portions to draw said pair of track portions toward one another and for engaging said flap portion outer surface.

5. An article of wearing apparel as set forth in claim 4 which includes, an imitation zipper actuator associated with said pair of zipper-type track portions, and said imitation zipper actuator being connected to said fastener to hang downwardly from said fastener below said pair of zipper-type track portions.

6. An article of wearing apparel as set forth in claim 1 in which said fastener elements include, a pair of zipper track portions positioned in spaced relation, each of said zipper track portions including a plurality of spaced apart teeth, and said pair of zipper track portions being connected in meshing relation at the lower ends thereof by said teeth of one track portion engaging said teeth of the other track portion.

7. An article of wearing apparel as set forth in claim 6 which includes, a slide portion for moving said lower ends of said pair of zipper track portions into meshing relation, and said track portions being secured to said flap portion outer surface by sewing said spaced apart teeth to said flap portion outer surface so that said track portions converge toward one another from the upper ends thereof to said slide portion.

8. A method of making a trouser construction comprising the steps of, positioning a zipper assembly on the outer surface of a trouser flap portion that overlies and conceals a trouser fly, twisting a pair of material strips each supporting a row of zipper teeth, positioning the twisted material strips in abutting relation and between the rows of zipper teeth extending the length of the material strips, securing the abutting material strips to the outer surface of the trouser flap portion, and extending the rows of zipper teeth in spaced relation from the upper ends of the zipper teeth toward one another to the lower end of the zipper teeth at the bottom of the trouser flap portion to simulate a trouser fly in an open position.

9. A method of making a trouser construction as set forth in claim 8 which includes, converging the material strip at the lower ends thereof so that the rows of zipper teeth are positioned closer together at the lower ends of the material strips than at the upper ends thereof.

10. A method of making a trouser construction as set forth in claim 8 which includes, positioning a slide for the zipper assembly in overlying relation with the lower ends of the rows of zipper teeth at the lower end of the trouser flap portion, and converging the rows of zipper teeth toward one another from the upper end of the trouser flap portion to the slide at the lower end of the trouser flap portion to give the appearance of a trouser with an open fly.

* * * * *